United States Patent [19]

Doyle et al.

[11] 4,005,812

[45] Feb. 1, 1977

[54] ELECTRIC FASTENER DRIVING TOOL

[75] Inventors: Richard H. Doyle, Mount Prospect; Salvatore L. Morabito, Northlake; Andrew I. Yohana, Des Plaines; Raymond F. Novak, Schiller Park, all of Ill.

[73] Assignee: Duo-Fast Corporation, Franklin Park, Ill.

[22] Filed: June 4, 1975

[21] Appl. No.: 583,847

[52] U.S. Cl. ..... 227/131

[51] Int. Cl.[2] ..... B25C 1/06

[58] Field of Search ..... 227/131; 335/219, 238, 335/249, 250, 251, 261, 264, 271, 274; 200/159 R

[56] References Cited

UNITED STATES PATENTS

| | | | |
|---|---|---|---|
| 2,572,012 | 10/1951 | Curtis | 227/131 |
| 2,881,402 | 4/1959 | Walker | 335/238 |
| 3,016,439 | 1/1962 | Hagberg | 200/159 R |
| 3,088,011 | 4/1963 | Ulbing | 335/261 |
| 3,586,810 | 6/1971 | Brown | 200/159 R |
| 3,589,587 | 6/1971 | Manganaro | 227/131 |

*Primary Examiner*—Granville Y. Custer, Jr.
*Attorney, Agent, or Firm*—Mason, Kolehmainen, Rathburn & Wyss

[57] ABSTRACT

An electric fastener driving tool includes a body of clamshell construction formed of two, similar, molded plastic body parts. The body includes a head portion and a handle portion, and a magazine for supplying fasteners to be driven is supported by the base of the head portion and by the handle. Walls and projections integral with the body parts define a solenoid chamber within the head cavity and support a switch and circuit board within the handle. The body is held in assembled condition and the magazine is attached to the body by bolts of equal length. A solenoid with a central axial opening is mounted in the solenoid chamber. An armature formed of magnetic and nonmagnetic, electrically insulated segments is slidably mounted in the axial solenoid opening. A spring contacting an integral body wall and the insulating armature segment biases the armature in the return direction. A driver blade carried by the armature may be attached in electrically insulated fashion, and moves in a drive path into which fasteners are supplied from the magazine. A circuit including a switch controls energization of the solenoid, and a switch operating assembly provides for fail-safe operation and prevents unintentional multiple firing.

18 Claims, 13 Drawing Figures

ELECTRIC FASTENER DRIVING TOOL

The present invention relates to improvements in electric fastener driving tools.

Electric tools for driving fasteners such as staples, tacks and the like are well known and widely used. Examples of tools of this character developed in the past may be found in U.S. Pat. Nos. 3,141,171; 3,172,121; 3,179,866 and 3,434,026, all assigned to the assignee of the present application. Such tools commonly include a housing having a handle portion, and a head portion containing a solenoid winding for accelerating a magnetic armature. Typically a control circuit is operated by a switch in the handle portion for energizing the winding. A magazine is carried by the base of the head portion and by the handle for introducing fasteners into a drive track to be driven by a driver blade supported by the armature. The present invention relates to improvements in electric fastener driving tools of this type.

Among the important objects of the present invention are to provide a tool which is light in weight, which is easily and economically manufactured, and which includes relatively few parts and requires a minimum of assembly operations.

Another object is to provide an electric fastener driving tool having a novel body structure including improved provision for mounting of components of the tool including the solenoid winding, the operating switch, and a circuit board.

Other objects of the invention are to provide a novel armature assembly for an electric fastener driving tool including both magnetic and nonmagnetic portions; to provide a tool including an improved structure for mounting the tool drive components including the solenoid winding; and to provide a tool having improved structures for insulating electrical components.

Yet another object of the present invention is to provide an improved switch operating arrangement for preventing inadvertent tool firing while providing fail-safe switch operation.

In brief, the above and other objects and advantages of the invention are realized in a preferred embodiment of the invention by providing an electric fastener driving tool including a tool body defining a head portion and a handle portion. The body is of clamshell construction and is formed of two similar plastic body parts having integral walls forming a solenoid chamber in the head portion and having integral projections for mounting of a switch and a circuit board in the handle portion. A magazine for supplying fasteners to be driven is supported on the handle portion and the base of the head portion. The components of the tool including the body parts and the magazine are held in assembled relation by a number of bolts of equal length.

In accordance with a feature of the invention a solenoid assembly is held between integral walls defining a solenoid chamber in the head portion. The solenoid assembly includes a pair of telescoping body parts defining a chamber for containing the solenoid winding, and defining a central axial opening through the winding. Resilient means are compressed adjacent the telescoping members between the spaced walls to hold the solenoid assembly in place.

One feature of the present invention relates to the structure of the armature assembly slidably movable in the central axial opening of the solenoid. The armature is formed of magnetic and nonmagnetic portions thereby reducing armature weight and concentrating magnetic material adjacent the solenoid winding. A spring for biasing the armature assembly to the return position is electrically isolated from the armature because it is in engagement with the nonmagnetic, electrically insulating armature portion.

A driver blade supported by the armature is movable in a drive track to drive fasteners supplied from the magazine. In accordance with one embodiment of the invention, insulating connecting means may be used to interconnect the drive blade and the armature. A resilient member in the drive track bears against the driver blade during rebound to dampen frictionally the rebound of the armature and driver blade.

In order to avoid inadvertent multiple firing or stuttering of the control switch, there is provided a novel switching apparatus for producing alternate switch operations at widely spaced positions of a trigger means. The switch apparatus also includes a fail-safe arrangement in the form of a limited movement connection for positively producing alternate switch operations regardless of variations in switch operating characteristics.

The present invention together with the above and other objects and advantages may be best understood from the following detailed description of the embodiments of the invention illustrated in the drawings, wherein.

Figure 3:
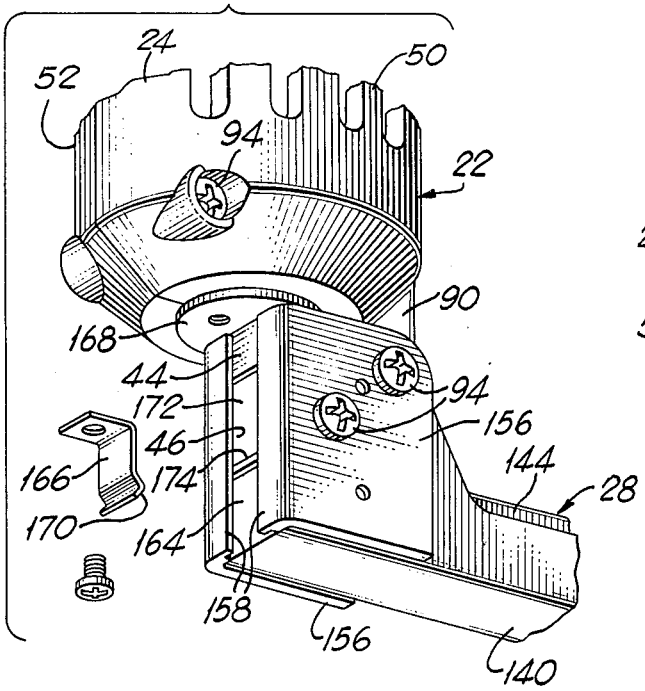
FIG. 3 is a fragmentary, partly exploded view of a portion of the tool.
Figure 2:
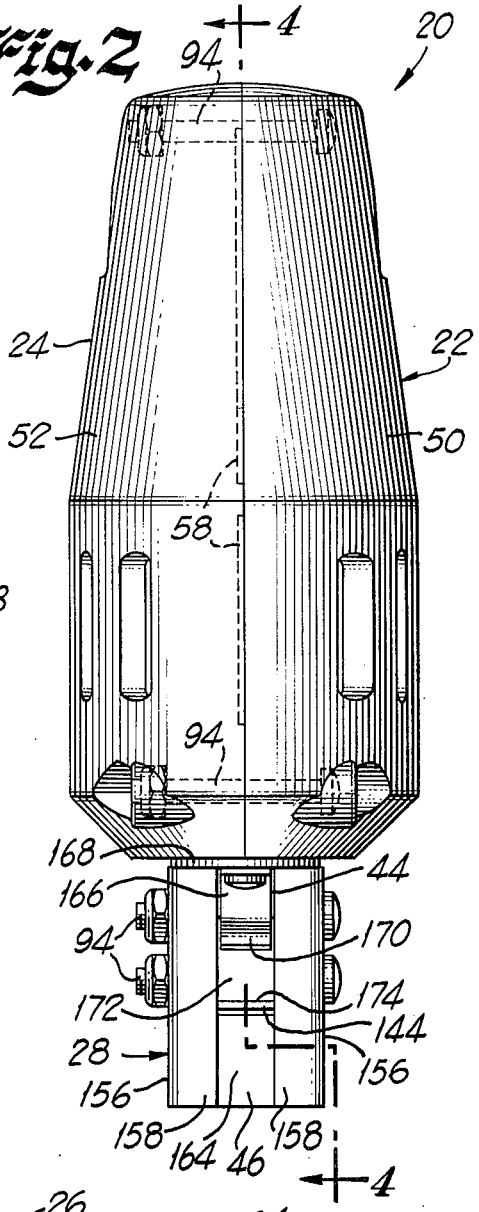
FIG. 2 is a front elevational view of the tool.
Figure 1:
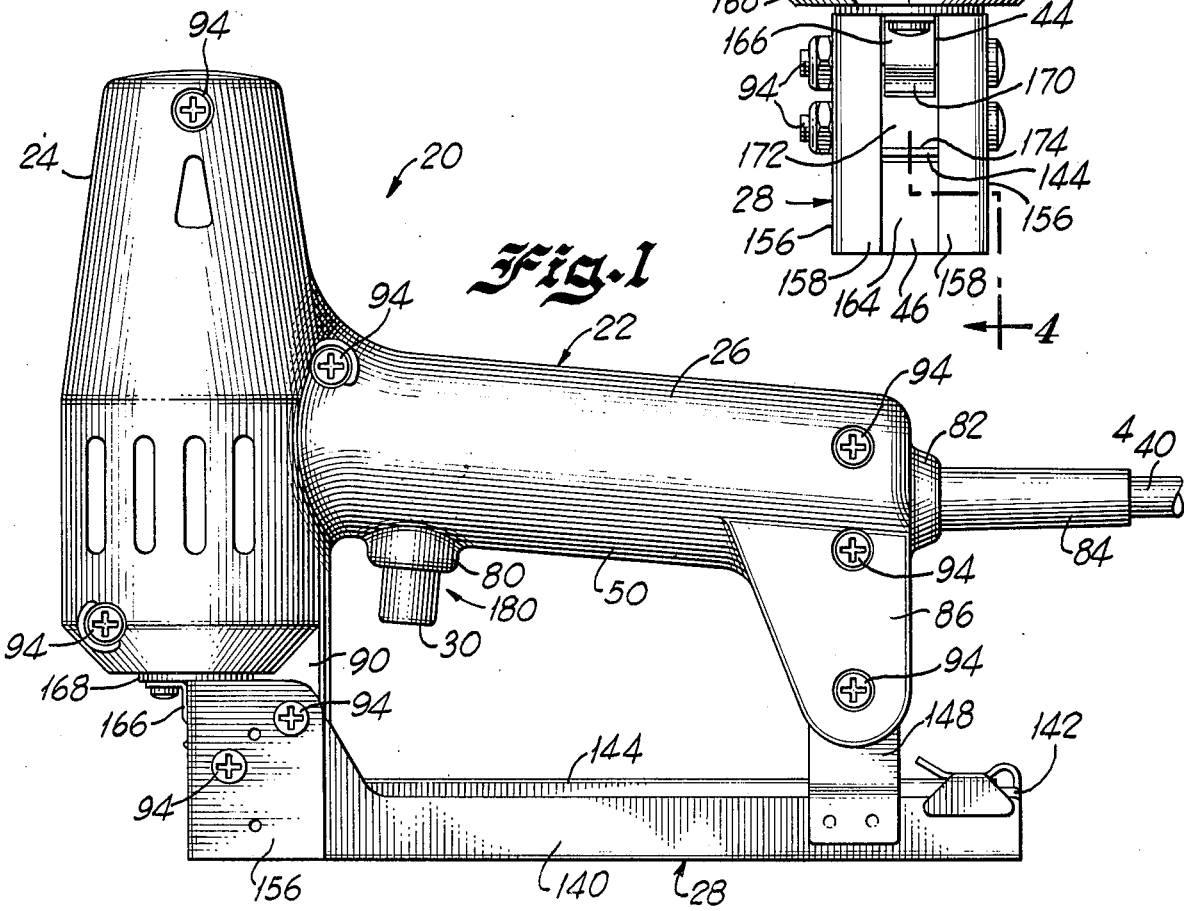
FIG. 1 is a side elevational view of an electric fastener driving tool constructed in accordance with the present invention.

Having reference now to the drawings, and initially to FIGS. 1–11, there is illustrated an electric fastener driving tool designated as a whole by the reference numeral 20 and constructed in accordance with the principles of the present invention. The tool 20 is designed for portable, hand held use, and includes a housing or body generally designated as 22 having a head portion 24 and a handle portion 26 adapted to be grasped by the hand of the user. A magazine assembly generally designated as 28 is adapted to contain a supply of fasteners to be driven. When a trigger element in the form of a push button 30 is operated by the user, a fastener is driven from the tool 20 into a workpiece.

Figures 4, 5, 6:
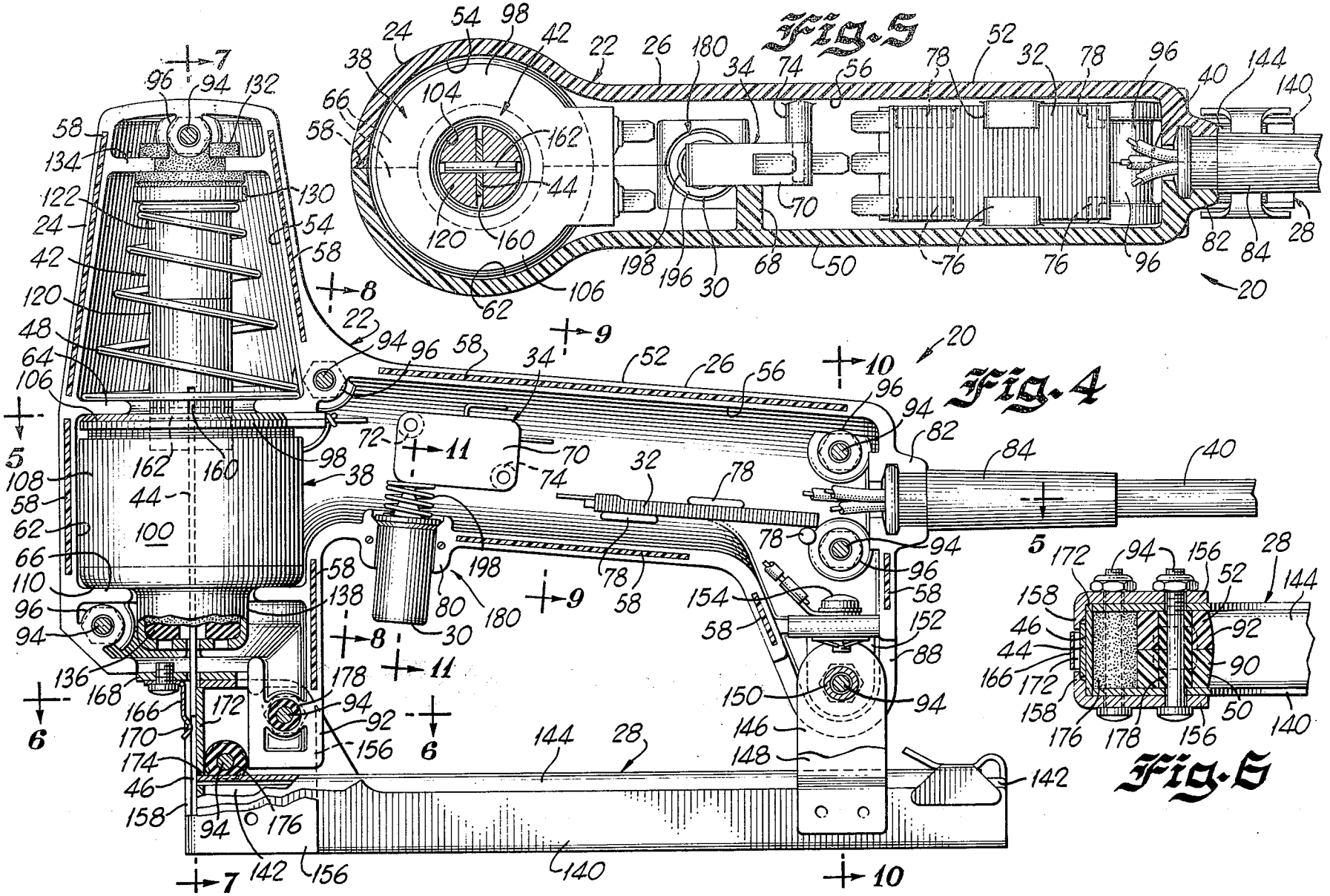
FIG. 4 is a sectional view taken along the line 4—4 of FIG. 2.
FIG. 5 is a sectional view taken along the line 5—5 of FIG. 4.
FIG. 6 is a sectional view taken along the line 6—6 of FIG. 4.

With reference now to FIG. 4, an electrical operating circuit including a circuit board 32, an operating switch 34 and a solenoid winding 36 associated with a solenoid assembly generally designated as 38 is contained within the body 22 and is interconnected with a source of operating potential by means of a power cord 40. A more detailed description of the structure and operation of the electrical operating circuit is not necessary to an understanding of the features of the present invention, and reference may be had to the disclosures of the above identified patents for descriptions of suitable electrical operating circuits.

In general, when push button 30 is operated by the user, operation of the switch 34 results in energization of the solenoid winding 36. As a result, an armature assembly generally designated as 42 is magnetically accelerated through a drive stroke, and a driver blade 44 carried by the armature assembly 42 moves through a drive track 46 to drive a fastener supplied by the magazine assembly 28. At the end of the drive stroke, a spring 48 returns the armature assembly 42 and blade 44 to the illustrated initial or return position.

One important feature of the present invention relates to the construction of the housing 22 and its relationship to various components of the tool 20. The housing is formed, preferably by molding, of a lightweight but strong and rigid, electrically insulating material such as a suitable plastic. Projections and walls formed integrally with the housing 22 are utilized in novel fashion to support components of the tool 20 without the necessity for additional fastening and supporting elements as have been required in the past. Moreover, the housing is fabricated in such a way that assembly steps and the number of different parts required in assembly are reduced to a minimum.

Proceeding now to a more detailed description of the housing 22, the housing is made up of two similar body parts 50 and 52 assembled together in clamshell fashion. The parts 50 and 52 are substantially symmetrical about, and interface or abut with one another at, a plane coinciding with the major vertical plane of symmetry of the housing 22 and tool 20. Each part 50 and 52 is of a concavo-convex shell-like structure, and when the parts 50 and 52 are assembled together, they define an elongated, generally vertically extending cavity 54 in the head portion 24 of the housing 22 and an elongated, transversely extending cavity 56 in the handle portion 26 of the housing 22.

In order precisely and securely to align the two body parts 50 and 52 when the housing 22 is assembled, the rim or edge wall of the part 52 is provided with a number of projections or ribs 58 best seen in FIG. 4. Upon assembly each rib 58 is received in a corresponding recess (FIGS. 9 and 10) to provide a tongue and groove connection.

Structure integral with the body parts 50 and 52 is used in novel fashion to support many components of the tool 20, including the solenoid assembly 38 and related components, other elements of the electric operating circuit including the switch 34 and the circuit board 32, and the magazine assembly 28. This arrangement makes possible a simple structure which is easily assembled and avoids the expense of a large number of different parts.

The solenoid assembly 38 is supported in a solenoid chamber 62 defined at the lower end or base of the head portion cavity 54 between a pair of spaced walls 64 and 66. Each wall 64 and 66 is made up of two wall segments of similar and symmetrical configuration integral respectively with the body parts 50 and 52. As a result of this novel arrangement, the solenoid assembly described in detail hereinafter, can readily be mounted within the solenoid chamber 62 prior to assembly of the two body parts.

Figures 7, 8, 9, 10, 11, 12, 13:
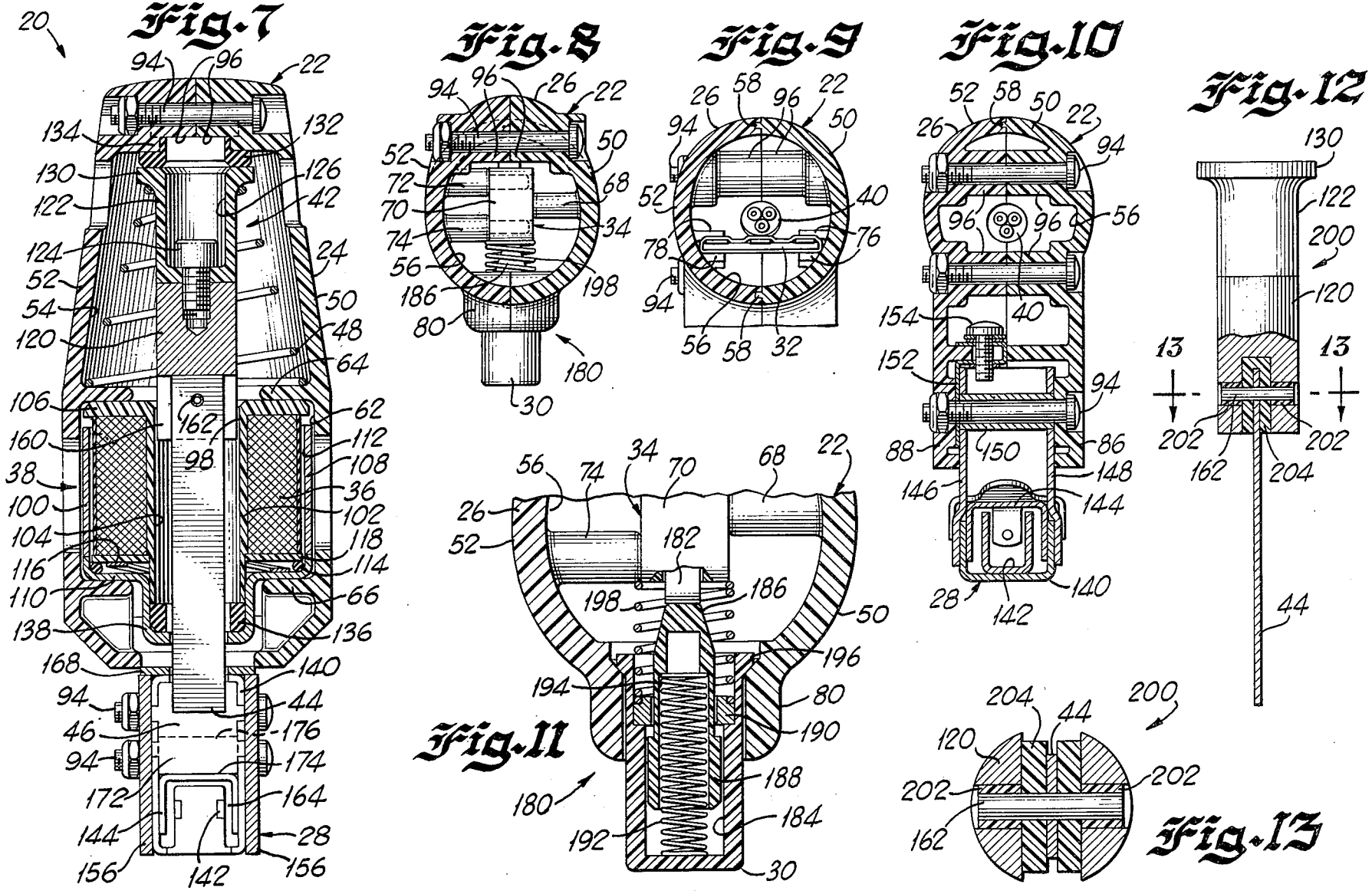
FIG. 7 is a sectional view taken along the line 7—7 of FIG. 4.
FIG. 8 is a sectional view taken along the line 8—8 of FIG. 4.
FIG. 9 is a sectional view taken along the line 9—9 of FIG. 4.
FIG. 10 is a sectional view taken along the line 10—10 of FIG. 4.
FIG. 11 is an enlarged, fragmentary, sectional view taken along the line 11—11 of FIG. 4.
FIG. 12 is a side view, partly in section, illustrating an alternative embodiment of the invention in the form of an armature assembly differing from that of the tool of FIG. 1.
FIG. 13 is a sectional view on an enlarged scale taken along the line 13—13 of FIG. 12.

The operating switch 34 is also supported between body parts 50 and 52. As best illustrated with reference to FIGS. 4, 5 and 8, the switch 34 is supported within the cavity 56 defined within the handle portion 26 by projections integral with the body parts 50 and 52. More specifically, the body part 50 is provided with an inwardly extending projection 68 adapted upon assembly to abut one side of a housing 70 of the switch 34. A pair of projections 72 and 74 extend inwardly from body part 52 and abut the opposite face of the switch housing 70. As best seen in FIG. 8, the projections 72 and 74 include reduced diameter portions received in mounting holes extending through the switch housing 70. The circuit board 32 is mounted within the handle cavity 56 in a similar manner by a number of projections 76 extending inwardly from the housing part 50 and similar projections 78 extending inwardly from the housing part 52. The body parts 50 and 52 also cooperate to define a pair of bosses 80 and 82 serving respectively to support the push button 30 and to capture a strain relief member 84 associated with the power cord 40.

Integral portions of the housing 22 also provide structure for mounting of the magazine assembly 28 to the housing. At the rearward extremity of the handle portion 26 the body parts 50 and 52 include downwardly extending spaced apart wall portions 86 and 88. As best appears in FIG. 10, these wall portions are adapted to receive and provide for the support of a rear end portion of the magazine assembly 28 described in more detail below. At the base of the head portion 24, the body parts 50 and 52 include a pair of downwardly extending projections 90 and 92 adapted to be received within and to support a forward portion of the armature assembly 42.

One advantage of the structure of the housing 22 is that upon assembly the body parts 50 and 52 are held in assembled relation, and the magazine assembly 28 is attached to the housing 22, by a number of fasteners 94 each of which is identical to the others. In the illustrated arrangement each of the fasteners 94 comprises a bolt having a threaded end receiving a nut, but it should be understood that other types of fastener devices may be used if desired. The use of a number of identical fasteners rather than various fasteners of different dimensions reduces the cost and difficulty of assembling the tool 20.

An important feature of the present invention resides in the improved structure of the tool for accomplishing reliable electrical insulation of components of the tool. Several structural features leading to this result are described below. At this point it should be noted that because the housing 22 is formed entirely of electrical insulating material, advantages are obtained over prior art tools including an entire body or a portion thereof formed of electrically conductive metal. It should also be noted that each of the fasteners 94 extending through the cavities 54 or 56 defined within the housing 22 is entirely surrounded by electrical insulating material integral with the housing. Thus, at the location of each fastener 94, the body parts 50 and 52 are provided with inwardly extending tubular projections 96 surrounding each fastener 94. Thus the fasteners, the ends of which are exposed at the exterior of the housing 20, cannot be inadvertently contacted by components of the electrical operating circuit.

The structure of the solenoid assembly 38 and the manner in which it is captured within the solenoid chamber 62 comprises one important aspect of the present invention. With reference now to FIGS. 4 and 7, the solenoid assembly 38 includes a pair of telescoping housing members 98 and 100. The inner member 98 includes a cylindrical wall 102 defining a central axial opening 104 extending through the solenoid assembly 38. The upper end of wall 102 is bounded by an end flange or wall 106 adapted to abut against the wall 64 of the solenoid chamber 62.

The solenoid assembly housing member 100 includes an outer cylindrical wall 108 surrounding and spaced from the cylindrical wall 102. The lower end of the wall 106 is bounded by an end flange or wall 110 adapted to abut against the wall 66 of the solenoid chamber 62. The two housing members 98 and 100 define between them an annular solenoid winding cavity 112 within which is received the solenoid winding 36.

Because the members 98 and 100 are in sliding telescoping relation and are not fixed to one another, it is possible to fabricate the winding 36 independently of the members 98 and 100 thereby to realize a savings in cost. After fabrication, the winding is mounted upon the cylindrical wall 102 against the end wall 106 of the housing member 98 and is covered by the member 100. A resilient gasket 114 or a resilient wave washer 116 or both may be sandwiched between the end wall 110 of the member 100 and a plate member 118 abutting the lower end of the solenoid winding 36. The resilient elements 114 and 116 permit the members 98 and 100 to be forced together while resiliently urging them apart. Thus, the solenoid assembly can be compressed for mounting between the walls 64 and 66 and the resilient members maintain the assembly firmly in place while compensating for different finished lengths of the prefabricated solenoid winding 36.

One aspect of the present invention relates to the structure of the armature assembly 42. As best illustrated in FIG. 7, the armature assembly includes two armature portions 120 and 122 of mating peripheral configuration held in assembled relation by suitable means such as a screw 124. The use of two discrete armature portions results in several advantages including a reduction in weight, efficient magnetic acceleration of the armature assembly 42, and improved electrical insulation of portions of the tool 20.

More specifically, the lower armature portion 120 is substantially solid and is formed of a magnetic metal material. Since portion 120 comprises the lowermost portion, it is disposed adjacent the solenoid assembly 38 prior to operation of the tool and remains under the influence of the most concentrated region of the magnetic field produced by the winding 36 during a drive stroke.

In accordance with the invention, the upper portion 122 of the armature assembly 42 is formed of a lightweight, electrically insulating material, preferably plastic. Portion 122 is substantially hollow, being recessed or counterbored as indicated by the reference numeral 126 to receive the screw 124. Since portion 122 is the upper portion, and is therefore the portion most distant from the solenoid winding 36, the fact that it is made of a nonmetallic material permits a saving in weight without material sacrifice of magnetic acceleration of the armature assembly 42.

The spring 48 biases the armature assembly 42 upwardly to the normal or return position illustrated in the drawings. The spring 48 is held in compression between the wall 64 formed integrally with the housing 22 and an enlarged flange portion 130 at the upper end of the armature portion 122. Since the spring 48 is captured between integral portions of the housing 22 and the armature assembly 42, no additional parts are required for mounting and capturing the spring. Moreover, since the spring contacts only elements formed of insulating plastic material, the spring is completely electrically isolated from electrical components and cannot complete an electrical circuit to the metallic portions of the armature assembly 42.

Travel of the armature assembly 42 in the upward direction is limited by a low rebound, upper stop or bumper member 132 fabricated from butyl rubber or the equivalent. Bumper member 132 serves to cushion as well as prevent rebound of the armature assembly 42. As can best be seen in FIGS. 4 and 7, the bumper member 132 is mounted in a simple and convenient manner upon a wall 134 formed by means of wall segments integral with the body parts 50 and 52. Downward movement of the armature assembly 42 during a drive stroke is limited by a lower stop or bumper member 136. Advantageously, this bumper member is mounted in an efficient manner within a projecting portion 138 of the end wall 110 of the solenoid assembly housing member 100. Depending upon the finished length of the solenoid winding 36, the resilient lower bumper 136 may be tightly captured between the cylindrical wall 102 of member 98 and the end of the projection 138, in which case the bumper 136 may assist the gasket 114 and washer 116 in resiliently separating the housing members 98 and 100.

The magazine assembly 28 defines the drive track 46 for the driver blade 44 and serves to advance fasteners to be fed one at a time into the drive track. The magazine assembly 28 may be of any conventional construction and in the illustrated arrangement includes a generally channel or U-shaped outer casing member 140 enclosing a lower channel member 142 and an upper channel member 144 defining between them a U-shaped feed path for advancing staple fasteners supplied in strip or stick form.

At the rear end of the magazine assembly, a pair of support arms 146 and 148 are attached to the casing member 140 and extend upwardly between the wall portions 86 and 88 of the housing 22. Rigidity is increased by the provision of a tube or strut 150 (FIG. 10) extending between the arms 146 and 148. One of the fasteners 94 extends through the strut 150 and through the walls 86 and 88 for fastening the rear end of the magazine assembly to the housing 22. In the embodiment of the invention illustrated in FIGS. 1–11, a grounding strap 152 and a ground connection screw 154 are provided for grounding the magazine assembly 92 to the ground conductor of the power cord 40.

At its forwardmost end, a pair of cap members 156 are attached to the casing member 140 by a pair of the fasteners 94. As best seen in FIG. 4, one of the fasteners 94 extends through the projections 90 and 92 of the housing 22 in order to attach the forward end of the magazine assembly 28 to the housing 22. The other of the fasteners 94 extends between the cap members 156 and through the casing member 140 to provide rigidity of the magazine assembly 28 in the region of the drive track 46. As best appears in FIGS. 4 and 6, the cap members 156 include flange portions 158 disposed at the front of the magazine assembly 28, and these flange portions are notched to define the lateral edges of the drive track 46.

With reference to FIGS. 4, 5 and 7, the driver blade 44 comprises a narrow elongated member having its upper end attached in a slot 160 in the lower armature portion 120 by means of an attaching pin 162. The lower end of the driver blade 44 is captured in the drive track 46 in the normal or returned position illustrated in the drawings. When the solenoid winding 36 is energized, the armature assembly 42 and the driver blade 44 descend abruptly to move the lower edge of the driver blade 44 through the drive track where it dislodges a fastener disposed at a drive position 164 (FIG. 7) and drives it into a workpiece.

Because a resilient stop means such as the lower bumper 136 is used for stopping the armature assembly 42 at the end of a drive stroke, a rebound problem may be encountered. Depending upon the resistance experienced during the drive stroke due to factors such as fastener size, workpiece resistance, and the like, the armature may be rebound upwardly at the end of a drive stroke. Moreover, when the armature assembly returns to its initial position, it may once again rebound downwardly from the upper stop member 132. In order to prevent inadvertent partial feeding of a second fastener in response to a single energization of the winding 36, in the illustrated arrangement substantial distance is provided between the lowermost edge of the driver blade 44 and the top of a fastener in the drive position 164 when the driver blade is in its normal or return position. Moreover, a resilient member 166 is also provided to serve as a frictional damper to dampen the rebound of the driver blade after the armature assembly contacts upper stop member 132.

With reference now to FIGS. 3 and 4, there is provided the resilient member 166 attached to a top plate 168 forming a part of the magazine assembly 28. The member 166 includes a finger 170 normally extending into the drive track 46 below the driver blade 44. Finger 170 bears against the driver blade 44 resulting in a frictional resistance to the movement of blade 44 of a magnitude sufficient to dampen the rebound of blade 44 while not significantly affecting movement of the blade 44 during a drive stroke.

At its rear side, the drive track is defined in part by means of a notched plate 172 received in and closing the forward end of the magazine assembly outer casing member 140. Although plate 172 is securely press fitted or otherwise firmly attached in position, over a period of time the forces and impacts experienced during many drive strokes might cause a loosening of the plate 172. In this event, it might be possible for the driver blade 44 to strike the forward edge of the upper channel member 144 at the region designated as 174 in FIGS. 4 and 7. In order to prevent this difficulty, the plate 168 is provided with backing through the agency of a bushing member 176 surrounding the forwardmost of the two fasteners 94 interconnecting the cap members 156. Thus, should the notched plate 172 become loose, the bushing 176 resiliently biases the lower end of the plate in a forward direction to capture and guide the driver member 44 in the drive track 46.

During each drive stroke when a fastener is abruptly moved from the drive position 164, a shock or impact is applied from the driver blade 44 and armature assembly 42 to the magazine assembly 28. In view of the fact that the tool housing 22 is formed of plastic material, such shocks and impacts might over a period of time lead to damage to the housing. For this reason, and in accordance with a feature of the invention, there is provided an impact absorbing connection between the magazine assembly 28 and the housing 22. More specifically, as illustrated in FIG. 4, a bushing member 178 of resilient, energy absorbing material is interposed between the housing projections 90 and 92 and the corresponding fastener 94.

Having reference now to FIG. 11 of the drawings, it is an important feature of the present invention to provide a novel switching assembly designated as a whole by the reference numeral 180 for reliably and safely operating the switch 34 by manipulation of the push button trigger element 30. Since the tool 20 of the present invention is relatively light in weight, during use appreciable rebound or recoil may occur as a result of a drive stroke. It is desirable to prevent such rebound from resulting in unintentional multiple operation of the switch 34. Moreover, it is desirable to assure that the switch 34 is reliably operated to its alternate conditions by inward and outward movements of the button 30 despite variations that may be experienced in the characteristics of the switch 34 or the elements of the switching assembly 180.

More specifically, the switch 34 may be of any of a number of commercially available switches including the housing 70 and including a lever 182 or other switch operating element for controlling the operation of the switch between alternate conditions. It is desirable in accordance with the invention that the switch have a differential between the operating forces applied to the lever 182 to produce alternate switch operations. For example, one commercially available switch useful for this purpose is the switch model number GVBFJ9/1097 available from Burgess Switch Company, Ltd. of the United Kingdom. When an operating force of approximately fourteen or fifteen ounces is applied to the lever 182 of this switch, the switch is initially operated from its illustrated released condition to its alternative operated condition. After this initial operation, overtravel of the lever 182 results in desirable contact actuation. Upon release of the switch, the force applied to lever 182 must decrease to a substantially lower force in the neighborhood of nine or ten ounces before the switch is operated to its illustrated, released condition.

In order to take advantage of this differential in switch operating force, the switching assembly 180 is designed to require substantial movement of the button 30 from the illustrated position until the switch 34 is operated, and in addition to require substantial outward movement of the button 30 after operation of the switch before the switch is released. In this manner, relatively small movements of the button 30 as might occur upon rebound or recoil of the tool 20 during use cannot cause unintended switch operation.

More specifically, as illustrated in FIG. 11 the button 30 includes a central axial recess 184 extending throughout substantially its entire length. Slidably received within the button 30 is a switch actuating member 186. An enlarged outer portion 188 of the actuating member 186 is captured in the recess 184 by means of a collar 190 attached as by press fitting within the recess 184. In this manner, the relative sliding movement between the button 30 and the actuating member 186 is limited to a predetermined distance.

A relatively light spring 192 having a relatively small spring rate is sandwiched in compression between the button 30 and the actuating member 186. In the illustrated arrangement, the relatively long, light spring 192 is accommodated by a central axial recess 194 extending from the outermost end of the actuating member 186. In accordance with the invention, the rate of the spring 192 is chosen so that in its extended position as illustrated in FIG. 11 the spring applies to the actuating member 186 and thus to the lever 182 a force that is somewhat smaller than the force required for release of the switch. Moreover, in its most compressed condition, at the end of limited sliding movement between button 30 and actuating member 186, the spring applies to the actuating member 186 and thus to lever 182 a force somewhat larger than the force required for initial actuation of the switch 34. In this manner it is assured that when button 30 is initially depressed, it will move through a substantial distance comprising a large portion of the distance of limited movement permitted between button 30 and actuating member 186 before the actuating member 186 applies to the lever 182 a force sufficient for switch actuation. During this initial movement, energy is stored in the compressed spring 192, and upon actuation this results in reliable overtravel movement of the lever 182 and reliable switch contact operation.

Due to the switching force differential of the switch 34, after the switch has been operated by depressing the button 30, release of the switch is not possible until the force applied by the actuating member 186 decreases substantially. Due to the provision of the spring 192 with its low rate, it is necessary to move the button 30 outwardly to a position near its fully outward location before the force applied to the lever 182 decreases sufficiently to permit release of the switch. Outward movement is limited by engagement of a flange 196 on the button 30 with the housing 22 as illustrated in FIG. 11.

Also in accordance with the invention, reliable fail-safe operation is provided both for switch actuating movement and for switch release movement of the button 30. More specifically, the button 30 is held in its illustrated outermost position by means of a spring 198 held in compression between switch 34 and collar 190. Spring 198 is substantially heavier than spring 192, and under all conditions experienced in operation of the switching assembly 180 the sprng 198 develops a force significantly in excess of that required for switch operation or release.

Due to production tolerance variations and/or changes in spring or contact characteristics after use, it may happen that the force provided by spring 192 when button 30 is depressed never reaches a level high enough to cause actuation of the switch 34. In this situation, due to limiting of the movement of button 30 relative to actuating member 186 to a limited distance, when the button moves through the limited range of movement it engages the actuating member 186 and moves the actuating member inwardly directly without further reliance on spring 192. In response to this movement, the switch 34 is operated since the necessary operating force is applied manually directly from the button 30.

In a similar manner, when the button 30 is released, it may happen that the spring 192 continues to apply to the member 186 a force larger than the force necessary for release of the switch 34. However, button 30 is moved outwardly to its outermost position by means of the spring 198. At some point during this movement, the collar 190 attached to button 30 engages the enlarged portion 188 of the actuating member 186 and directly moves the actuating member outwardly, again without reliance upon spring 192. In this manner the spring 198 acts directly on the actuating member 186 through the agency of direct physical contact between button 30 and member 186 to reliably assure release of the switch.

In one embodiment of the present invention utilizing the Burgess Switch Company switch identified above, the spring 192 is selected so that in its illustrated extended condition it develops a force of about seven ounces and so that in its compressed condition it develops a force of about 16.5 ounces. Spring 198 is chosen so that it develops a force ranging between about 18.5 and 57.5 ounces as spring 198 is compressed from its illustrated to its most compressed condition. In this arrangement, limited movement of about (25/64) inch is permitted between the actuating member 186 and the button 30. These specific figures are set forth as an example of one embodiment of the invention and are not intended to limit the scope of the invention.

As indicated above, one important advantage of the tool 20 is that desirable electrical isolation is achieved between all electrical components of the tool and the exterior of the tool. Indeed, this electrical isolation is of so reliable a nature that the tool 20 can readily be adapted to "double insulated" use wherein a ground conductor is not required in the power cord 40. Having reference now to FIGS. 12 and 13, there is illustrated an alternative armature assembly construction generally designated by the reference numeral 200 which may be useful in providing a double insulated tool. The armature assembly 200 is similar in most respects to the armature assembly 42 described above and is interchangeable therewith. Similar reference numerals are used for those elements of the two assemblies which are similar.

In the armature assembly 200, the driver blade 44 is not in electrically conductive, metal-to-metal contact with the lowermost armature portion 120 of the armature assembly. This is achieved by surrounding the attaching pin 162 with tubular electrically insulating bushing members 202. Similarly, the upper end of the driver blade 44 is electrically isolated from the slot 160 by means of an electrically insulating sleeve 204. This modification assures that even if the conductive armature portion 120 should, through wear, defect or the like, come into electrical contact with circuit portions such as the solenoid winding 36, nevertheless the driver blade 44 is not subjected to electrical potential.

It also should be noted that in a double insulated tool, the ground strap 152 and connection screw 154 may be omitted and no electrical connections would exist between any electrical components and the magazine assembly 28.

While the invention has been described with reference to details of the illustrated embodiments, such details are not intended to limit the scope of the invention as defined in the following claims.

What is claimed and desired to be secured by Letters Patent of the United States is:

1. An electric fastener driving tool comprising:
a clamshell body including first and second similar molded plastic body parts abutting one another along a plane coinciding with the vertical plane of symmetry of the body, said body including a head portion enclosing a cavity and a handle portion integral with and extending from said head portion;
wall means integral with said body parts extending into said cavity and defining a solenoid chamber;
a solenoid winding having a central axial opening supported within said solenoid chamber by said wall means;
an armature slidable in said central axial opening in drive and return strokes;
a driver blade supported by said armature;
a magazine assembly supported by said body at the base of said head portion and at said handle portion, said magazine assembly defining a drive track for said driver blade and including means for introducing fasteners into said drive track;
circuit means including a switch supported within said handle portion for selectively controlling the energization of said solenoid winding;
said armature including a first segment formed of magnetic material and a second segment formed of electrically insulating material; and
electrically insulating connection means supporting said driver blade on said first segment of said armature.

2. An electric fastener driving tool comprising:
a clamshell body including first and second similar molded plastic body parts abutting one another along a plane coinciding with the vertical plane of symmetry of the body, said body including a head portion enclosing a cavity and a handle portion integral with and extending from said head portion;
wall means integral with said body parts extending into said cavity and defining a solenoid chamber;
a solenoid winding having a central axial opening supported within said solenoid chamber by said wall means;
an armature slidable in said central axial opening in drive and return strokes;
a driver blade supported by said armature;
a magazine assembly supported by said body at the base of said head porton and at said handle portion, said magazine assembly defining a drive track for said driver blade and including means for introducing fasteners into said drive track;
circuit means including a switch supported within said handle portion for selectively controlling the energization of said solenoid winding; and
impact absorbing means connecting said magazine assembly to the base of said head portion.

3. In an electric fastener driving tool, an improved drive component assembly comprising: housing means including two separable housing parts cooperating to define an elongated cavity, spaced walls integral with said housing defining a solenoid chamber in said cavity, a solenoid assembly comprising a pair of telescoping members defining an annular chamber surrounding a central axial opening, a winding mounted in said chamber, said solenoid assembly being mounted within said solenoid chamber between said spaced walls, resilient means in compression between said spaced walls adjacent said telescoping members for holding said telescoping members fixed between said spaced walls, and an armature assembly including a fastener driving blade slidably mounted for movement along a path extending through said central axial opening.

4. The assembly of claim 3, said housing parts abutting along a plane generally coincident with the central longitudinal axis of said cavity.

5. The assembly of claim 3, first resilient stop means supported in said central axial opening by one of said telescoping members for limiting movement of said armature assembly in a first direction.

6. The assembly of claim 5, second stop means engageable between said armature assembly and said housing means in said cavity for limiting movement of said armature assembly in a second direction, and biasing means coupled between said housing means and armature assembly for urging said armature assembly toward said second stop means.

7. The assembly of claim 6, said biasing means comprising a spring in compression between one of said spaced wall means and a portion of said armature assembly, said portion being formed of electrically insulating material.

8. The assembly of claim 3, said resilient means being sandwiched between said telescoping members.

9. In an electric fastener driving tool, the combination comprising: a tool body including a head portion and a handle portion, an elongated cavity defined within said head portion, means defining a drive track extending from a first end of said cavity, a magazine for supplying fasteners to be driven at a drive position in said drive track, a solenoid winding supported in said cavity adjacent said first end, said winding having a central axial opening, an armature having an enlarged flange at one end and having an elongated, generally cylindrical body slidably movable in said opening, a metal spring engaging said armature flange and urging said armature away from said first end and toward a second end of said cavity, a driver blade supported by said armature and movable in said drive track, and control means for selectively energizing said winding to move said armature away from said second end and toward said first end of said cavity for moving said driver blade from an initial position through said drive position in said drive track, said armature including a first portion of magnetic material and a second portion of nonmagnetic electrically insulating material attached to said first portion, said second portion being disposed closer to said second end of said cavity than said first portion, said second portion including said flange and a substantial part of said generally cylindrical armature body, a part of said second armature portion and all of said first armature portion being slidable in said central axial opening of said winding.

10. The combination of claim 9, said second portion being at least partially hollow and said first portion being substantially solid.

11. The combination of claim 9, said second portion comprising the end segment of said armature spaced from said winding.

12. The combination of claim 9, said driver blade comprising a metal element attached to said first armature portion.

13. In an electric fastener driving tool, the combination comprising: a tool body including a head portion and a handle portion, an elongated cavity defined within said head portion, means defining a drive track extending from a first end of said cavity, a magazine for supplying fasteners to be driven at a drive position in said drive track, a solenoid winding supported in said cavity adjacent said first end, said winding having a central axial opening, an armature slidably movable in said opening, biasing means urging said armature away from said first end and toward a second end of said cavity, a driver blade supported by said armature and movable in said drive track, control means for selectively energizing said winding to move said armature away from said second end and toward said first end of said cavity for moving said driver blade from an initial position through said drive position in said drive track, said armature including a first portion of magnetic material and a second portion of nonmagnetic material fixed with respect to said first portion, said second portion being disposed closer to said second end of said cavity than said first portion, said driver blade comprising a metal element attached to said first armature portion and electrically insulating connecting means for attaching said driver blade.

14. In an electric fastener driving tool, the combination comprising: a tool body including a head portion and a handle portion, an elongated cavity defined within said head portion, means defining a drive track extending from a first end of said cavity, a magazine for supplying fasteners to be driven at a drive position in said drive track, a solenoid winding supported in said cavity adjacent said first end, said winding having a central axial opening, an armature slidably movable in said opening, biasing means urging said armature away from said first end and toward a second end of said cavity, a driver blade supported by said armature and movable in said drive track, control means for selectively energizing said winding to move said armature away from said second end and toward said first end of said cavity for moving said driver blade from an initial position through said drive position in said drive track, said armature including a first portion of magnetic material and a second portion of nonmagnetic material fixed with respect to said first portion, said second portion being disposed closer to said second end of said cavity than said first portion; and resilient guide means engageable with said driver blade in said drive track between said initial and drive positions.

15. A switching apparatus for controlling the energization of an electrically operated impact tool, said apparatus comprising:

a hand held housing;

a switch device supported by said housing and having a differential between the operating forces required for alternate switch operations;

an actuator member movably mounted to engage and operate said switch device;

a manually movable trigger member mounted for movement relative to said actuator member;

a limited movement connection interconnecting said actuator member and trigger member and limiting movement therebetween to a predetermined distance;

means mounting said trigger member for movement toward and away from said switch;

a first spring means urging said trigger member away from said switch with a force substantially in excess of said switch operating forces; and a second spring means urging said trigger member and actuator member apart, the spring rate of said second spring means being chosen to apply between said actuator member and said trigger member a spring force varying between a minimum and a maximum as said trigger member moves relative to said actuator member through said predetermined distance;

said minimum spring force being less than the smaller of said switch operating forces and said maximum spring force being larger than the larger of said switch operating forces.

16. A switching apparatus as claimed in claim 15, said trigger member comprising a button.

17. A switching apparatus as claimed in claim 16, said limited movement connection comprising a recess in said button, an enlarged portion of said actuator member slidably mounted in said recess, and means capturing said enlarged portion within said recess.

18. A switching assembly as claimed in claim 17, said first spring means being in compression between said button and said switch, and said second spring means in said recess in compression between said button and said actuator.

* * * * *